US012486637B2

(12) United States Patent
Okamune et al.

(10) Patent No.: US 12,486,637 B2
(45) Date of Patent: Dec. 2, 2025

(54) MOTOR GRADER AND REPRESENTATION CONTROL METHOD

(71) Applicant: KOMATSU LTD., Tokyo (JP)

(72) Inventors: Yuki Okamune, Tokyo (JP); Hirohito Hagiwara, Tokyo (JP); Kengo Yamamoto, Tokyo (JP); Hiroki Nagasaki, Tokyo (JP); Takeshi Kamimae, Tokyo (JP)

(73) Assignee: KOMATSU LTD., Tokyo (JP)

( * ) Notice: Subject to any disclaimer, the term of this patent is extended or adjusted under 35 U.S.C. 154(b) by 754 days.

(21) Appl. No.: 17/797,796

(22) PCT Filed: Dec. 24, 2020

(86) PCT No.: PCT/JP2020/048432
§ 371 (c)(1),
(2) Date: Aug. 5, 2022

(87) PCT Pub. No.: WO2021/181823
PCT Pub. Date: Sep. 16, 2021

(65) Prior Publication Data

US 2023/0060917 A1 Mar. 2, 2023

(30) Foreign Application Priority Data

Mar. 13, 2020 (JP) ..... 2020-044774

(51) Int. Cl.
*E02F 3/815* (2006.01)
*E02F 9/26* (2006.01)

(52) U.S. Cl.
CPC ..... *E02F 3/815* (2013.01); *E02F 9/265* (2013.01)

(58) Field of Classification Search
CPC . E02F 3/815; E02F 3/764; E02F 3/765; E02F 3/844; E02F 9/265; E02F 9/262; E02F 9/261; E02F 9/264
See application file for complete search history.

(56) References Cited

U.S. PATENT DOCUMENTS

| | | | | |
|---|---|---|---|---|
| 5,951,613 | A | 9/1999 | Sahm et al. | |
| 2004/0010359 | A1 | 1/2004 | Koch | |
| 2013/0255977 | A1 | 10/2013 | Braunstein et al. | |
| 2013/0304331 | A1* | 11/2013 | Braunstein | E02F 3/847 701/50 |
| 2014/0088824 | A1* | 3/2014 | Ishimoto | E02F 9/0841 348/148 |
| 2014/0190046 | A1 | 7/2014 | Shibata | |

(Continued)

FOREIGN PATENT DOCUMENTS

| | | | |
|---|---|---|---|
| CN | 103492646 | A | 1/2014 |
| JP | S58-173230 | A | 10/1983 |

(Continued)

*Primary Examiner* — Russell Frejd
(74) *Attorney, Agent, or Firm* — Faegre Drinker Biddle & Reath LLP

(57) ABSTRACT

A motor grader includes a front frame, a rear frame, an actuator that pivots the front frame with respect to the rear frame, an operator operation apparatus, a display apparatus, and a controller. The controller causes the display apparatus to show any one of an image showing a state of pivot and an image different from the image showing the state of pivot, based on a signal from the operator operation apparatus.

22 Claims, 10 Drawing Sheets

(56) References Cited

U.S. PATENT DOCUMENTS

| | | | | |
|---|---|---|---|---|
| 2014/0326471 | A1* | 11/2014 | Zhu | E02F 3/765 701/50 |
| 2016/0150189 | A1* | 5/2016 | Kriel | H04N 7/181 348/148 |
| 2016/0152264 | A1 | 6/2016 | Watanabe et al. | |
| 2016/0186413 | A1 | 6/2016 | Tanaka et al. | |
| 2016/0301864 | A1* | 10/2016 | Petrany | B60R 1/27 |
| 2018/0063427 | A1* | 3/2018 | Ali | B60R 1/27 |
| 2018/0106014 | A1* | 4/2018 | Horstman | E02F 9/2037 |
| 2018/0209120 | A1* | 7/2018 | Gentle | G01C 9/02 |
| 2020/0299934 | A1 | 9/2020 | Ono | |

FOREIGN PATENT DOCUMENTS

| | | | |
|---|---|---|---|
| JP | H10-141955 | A | 5/1998 |
| JP | 2004-44375 | A | 2/2004 |
| JP | 2016-101872 | A | 6/2016 |
| JP | 2017-172187 | A | 9/2017 |
| JP | 2018-006943 | A | 1/2018 |
| JP | 2018-44328 | A | 3/2018 |
| WO | WO-2012/157379 | A1 | 11/2012 |
| WO | WO-2015/088048 | A1 | 6/2015 |

* cited by examiner

MOTOR GRADER AND REPRESENTATION CONTROL METHOD

TECHNICAL FIELD

The present disclosure relates to a motor grader and a method of controlling representation in a motor grader.

BACKGROUND ART

A motor grader of an articulation type has conventionally been known.

For example, a motor grader disclosed in WO2015/088048 (PTL 1) can show a state of articulation on a display apparatus in an operator's cab. An operator of the motor grader operates the motor grader while the operator observes this representation.

A technique to show a state of a specific function such as automatic control while the specific function is being performed in a work machine such as a motor grader or a crawler dozer has been known.

For example, in Japanese Patent Laying-Open No. 58-173230 (PTL 2), a finish inclination angle is shown while a motor grader is carrying out cross gradient control.

CITATION LIST

Patent Literature

PTL 1: WO2015/088048

PTL 2: Japanese Patent Laying-Open No. 58-173230

SUMMARY OF INVENTION

Technical Problem

A motor grader includes a blade in the vicinity of the ground in order to do land grading works and the like. Since an operator within an operator's cab has to do works while the operator directly looks at the blade, the motor grader should be structured to ensure a sufficient field of view forward and downward.

Therefore, a display area of a display apparatus of the motor grader is preferably as small as possible.

In showing a state of a specific function on the display apparatus while the motor grader is performing the specific function, on the other hand, a state of articulation may not be shown on the display apparatus due to the size of the display area of the display apparatus.

In such a case, even when the operator performs an operation to change the state of articulation while the function is being performed, the operator is unable to visually recognize on the display apparatus, how the state of articulation is.

The present disclosure provides a motor grader capable of showing a state of articulation on a display apparatus at timing suitable for an operator.

Solution to Problem

According to one aspect of the present disclosure, a motor grader includes a front frame, a rear frame, an actuator that pivots the front frame with respect to the rear frame, an operator operation apparatus, a display apparatus, and a controller. The controller causes the display apparatus to show any one of an image showing a state of pivot and an image different from the image showing the state of pivot based on a signal from the operator operation apparatus.

According to another aspect of the present disclosure, a motor grader includes a front frame, a rear frame, an actuator that pivots the front frame with respect to the rear frame, a display apparatus, and a controller that causes the display apparatus to show an image showing a state of pivot. The controller does not allow the display apparatus to show the image showing the state of pivot while a specific function is active in the motor grader. The controller causes the display apparatus to show the image showing the state of pivot when the controller receives a command to cause the actuator to operate while the image showing the state of pivot is not shown on the display apparatus owing to the specific function being active.

According to yet another aspect of the present disclosure, a method of controlling representation in a motor grader including a controller includes causing a display apparatus to show an image showing a state of articulation of the motor grader, receiving a signal from an operator operation apparatus, and causing the display apparatus to show any one of an image showing the state of articulation and an image different from the image showing the state of articulation based on the received signal.

According to still another aspect of the present disclosure, a method of controlling representation in a motor grader including a controller includes causing a display apparatus to show an image showing a state of articulation of the motor grader, deactivating causing the display apparatus to show the image showing the state of articulation while a specific function is active in the motor grader, receiving a command to cause an actuator for carrying out articulation to operate while the image showing the state of articulation is not shown on the display apparatus owing to the specific function being active, and causing the display apparatus to show the image showing the state of articulation based on reception of the command.

Advantageous Effects of Invention

According to the present disclosure, a state of articulation can be shown on a display apparatus at timing suitable for an operator.

DESCRIPTION OF EMBODIMENTS

Figure 1:
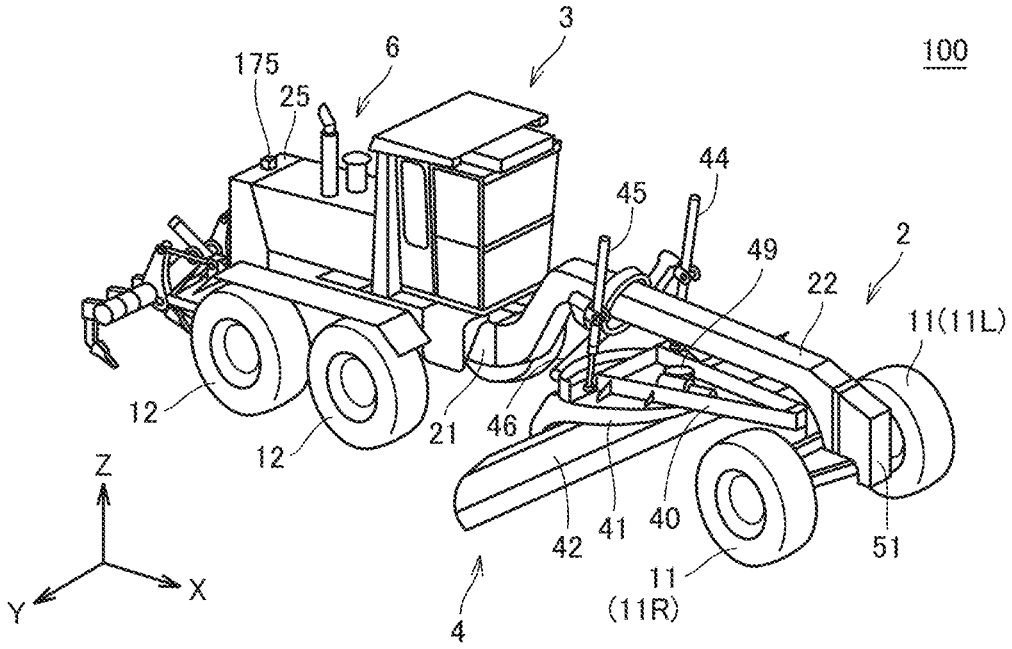
FIG. 1 is a perspective view schematically showing a construction of a motor grader of an articulation type based on an embodiment.

An embodiment will be described below with reference to the drawings. In the description below, the same elements have the same reference characters allotted and their labels and functions are also the same. Therefore, detailed description thereof will not be repeated.

<A. Overall Construction>

Figure 2:
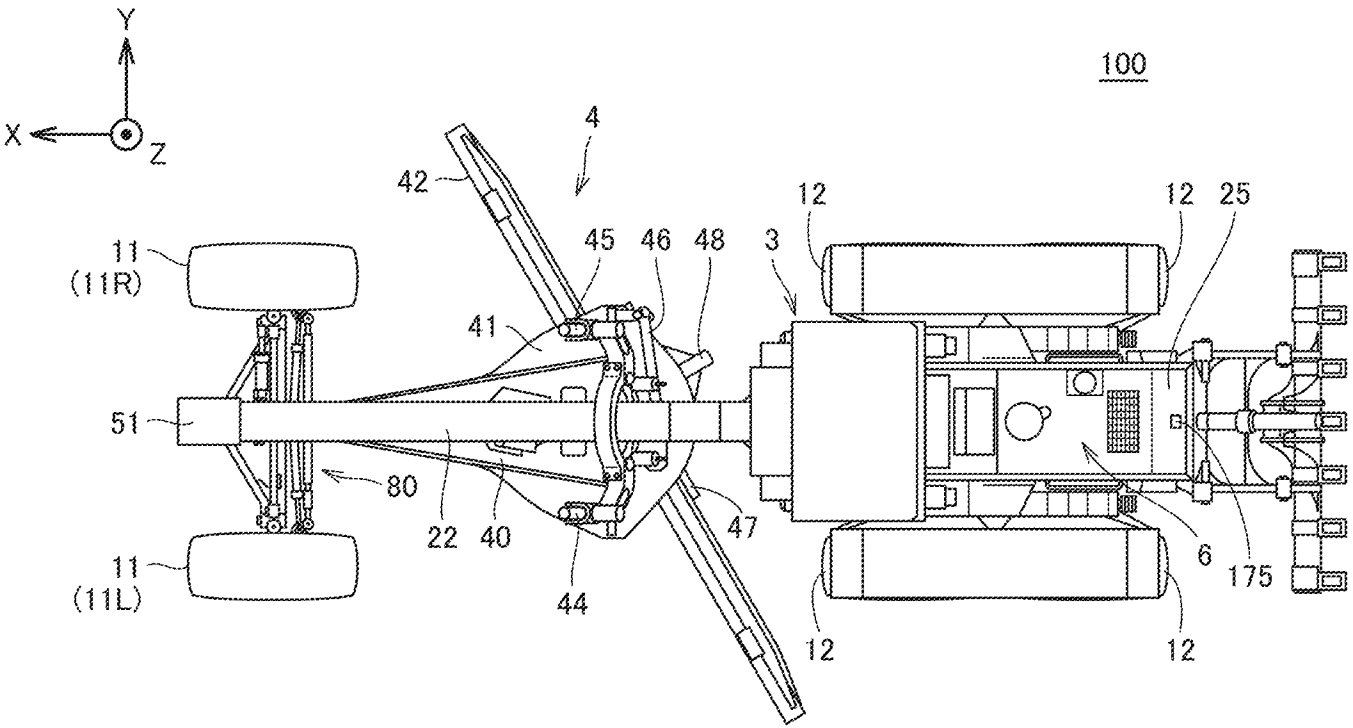
FIG. 2 is a plan view of the motor grader shown in FIG. 1.

FIG. 1 is a perspective view schematically showing a construction of a motor grader 100 of an articulation type based on an embodiment. FIG. 2 is a plan view of motor grader 100 shown in FIG. 1.

As shown in FIGS. 1 and 2, motor grader 100 based on the embodiment is constituted of a vehicular body 2 and a work implement 4. Vehicular body 2 mainly includes a front wheel 11 which is a running wheel, a rear wheel 12 which is a running wheel, a rear frame 21, a front frame 22, and a cab 3. Front wheel 11 includes one wheel on each of left and right sides and includes a right front wheel 11R and a left front wheel 11L. Though the figure shows running wheels including two front wheels 11, one on each side, and four rear wheels 12, two on each side, the number and arrangement of front wheels and rear wheels are not limited as such.

Motor grader 100 includes components such as an engine arranged in an engine compartment 6. Work implement 4 includes a blade 42. Motor grader 100 can do such works as land-grading works, snow removal works, light cutting, and mixing of materials with blade 42.

In the description of the drawings below, a direction in which motor grader 100 travels in straight lines is referred to as a fore/aft direction of motor grader 100. In the fore/aft direction of motor grader 100, a side where front wheel 11 is arranged with respect to work implement 4 is defined as the fore direction. In the fore/aft direction of motor grader 100, a side where rear wheel 12 is arranged with respect to work implement 4 is defined as the rear direction. A lateral direction or a side of motor grader 100 is a direction orthogonal to the fore/aft direction in a plan view. A right side and a left side in the lateral direction in facing front are defined as a right direction and a left direction, respectively. An upward/downward direction of motor grader 100 is a direction orthogonal to the plane defined by the fore/aft direction and the lateral direction. A side in the upward/downward direction where the ground is located is defined as a lower side and a side where the sky is located is defined as an upper side.

In the drawings below, the fore/aft direction is shown with an arrow X in the drawings, the lateral direction is shown with an arrow Y in the drawings, and the upward/downward direction is shown with an arrow Z in the drawings.

Rear frame 21 is arranged in the rear of front frame 22. Rear frame 21 supports an exterior cover 25 and components such as an engine arranged in engine compartment 6. Exterior cover 25 covers engine compartment 6. For example, rear wheels 12, two on each side, are attached to rear frame 21 as being rotatably driven by driving force from the engine.

Cab 3 is carried on rear frame 21. Cab 3 includes an indoor space which an operator enters and it is arranged at a front end of rear frame 21. Cab 3 may be carried on front frame 22.

In cab 3, an operator operation apparatus such as a steering wheel for steering front wheel 11, a gear shift lever, a lever for controlling work implement 4, a brake pedal, and an accelerator pedal is provided.

Front frame 22 is attached in front of rear frame 21. For example, front wheels 11, one on each side, are rotatably attached to a front end portion of front frame 22. Front wheel 11 is attached as being steerable with extending and retracting of a steering cylinder 80. Front wheel 11 is attached to be able to laterally lean with extending and retracting of a leaning cylinder 92 (see FIG. 5). A counterweight 51 is attached to the front end portion of front frame 22.

Work implement 4 mainly includes a draw bar 40, a swing circle 41, blade 42, a hydraulic slewing motor 49, and various cylinders 44 to 48.

Draw bar 40 has a front end portion swingably attached to a tip end portion of front frame 22. Draw bar 40 has a rear end portion supported on front frame 22 by a pair of lift cylinders 44 and 45. As a result of synchronous extending and retracting of the pair of lift cylinders 44 and 45, the rear end portion of draw bar 40 can move up and down with respect to front frame 22. Draw bar 40 is vertically swingable with an axis along a direction of travel of the vehicle being defined as the center, as a result of extending and retracting of lift cylinders 44 and 45 different from each other.

A draw bar shift cylinder 46 is attached to front frame 22 and one side end portion of draw bar 40. As a result of extending and retracting of draw bar shift cylinder 46, draw bar 40 is movable laterally with respect to front frame 22.

Swing circle 41 is revolvably supported on the rear end portion of draw bar 40. Swing circle 41 can be driven by slewing motor 49 as being revolvable clockwise or counterclockwise with respect to draw bar 40 when viewed from above the vehicle. As swing circle 41 is driven to revolve, an angle of inclination (which will also be referred to as a "blade propulsive angle" below) of blade 42 with respect to front frame 22 in the plan view is adjusted. In work implement 4 shown in FIG. 2, swing circle 41 is located at a position set by counterclockwise revolution in the plan view as compared with arrangement shown in FIG. 1. Therefore, blade 42 shown in FIG. 2 is arranged at a position different from blade 42 shown in FIG. 1.

Blade 42 is supported on swing circle 41. Blade 42 is supported on front frame 22 with swing circle 41 and draw bar 40 being interposed.

A blade shift cylinder 47 is attached to swing circle 41 and blade 42 and arranged along a longitudinal direction of blade 42. With blade shift cylinder 47, blade 42 is movable in the lateral direction with respect to swing circle 41.

A tilt cylinder 48 is attached to swing circle 41 and blade 42. As a result of extending and retracting of tilt cylinder 48, blade 42 swings around the axis extending in the longitudinal direction thereof with respect to swing circle 41, and can change its orientation in the upward/downward direction.

As set forth above, blade 42 is able to move up and down with respect to the vehicle, swing around the axis along the direction of travel of the vehicle, move in the lateral direction, and swing around the axis extending in the longitudinal direction thereof, with draw bar 40 and swing circle 41 being interposed.

<B. Cab>

Figure 3:
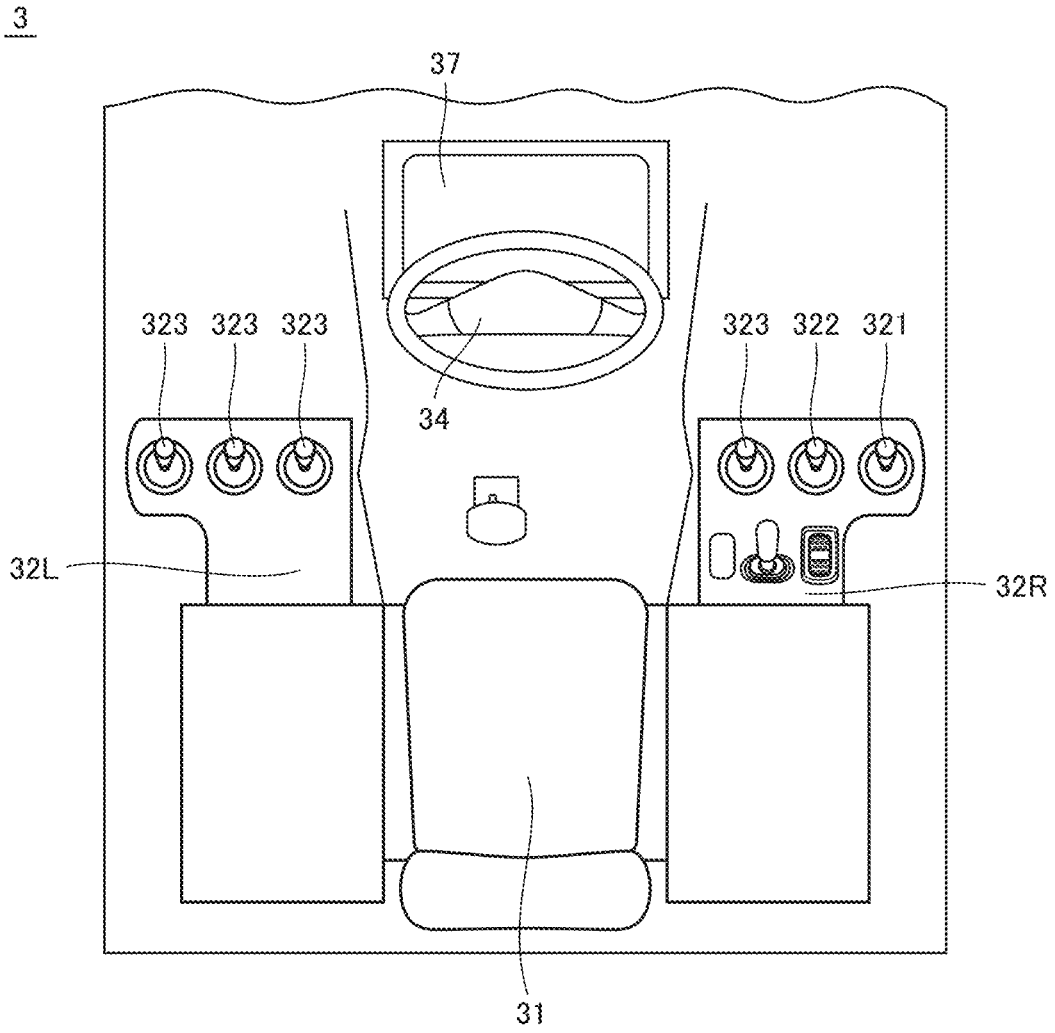
FIG. 3 is a plan view showing a construction of the inside of a cab of the motor grader.

FIG. 3 is a plan view showing a construction of the inside of cab 3 of motor grader 100.

As shown in FIG. 3, motor grader 100 mainly includes within cab 3, an operator's seat 31, consoles 32R and 32L, a steering wheel 34, and a display apparatus 37.

Operator's seat 31 is a seat where an operator who operates motor grader 100 sits. Consoles 32R and 32L are arranged laterally to operator's seat 31.

A control lever which is an operator operation apparatus is supported on an upper portion of each of consoles 32R and 32L.

The control lever supported on the upper portion of each of consoles 32R and 32L mainly includes at least an articulation control lever 321, a leaning control lever 322, and a plurality of work implement control levers 323.

Steering wheel 34 is arranged in front of operator's seat 31. Steering wheel 34 serves to operate a steering mechanism to steer front wheel 11 of motor grader 100. When the operator rotationally operates steering wheel 34, motor grader 100 can revolve. A steering lever instead of the steering wheel may be provided to allow steering by a lever operation. Alternatively, both of the steering wheel and the steering lever can also be provided.

Various types of information are shown on display apparatus 37. Display apparatus 37 is, for example, a liquid crystal display apparatus. The operator can determine a state of motor grader 100 based on information shown on display apparatus 37. A main controller (FIG. 6) causes display apparatus 37 to show various types of information. Examples of information shown on display apparatus 37 will be described later.

<C. Articulation>

Motor grader 100 can perform an articulation operation for pivoting front frame 22 with respect to rear frame 21. Motor grader 100 includes a pivot mechanism for performing the articulation operation.

Figure 4:
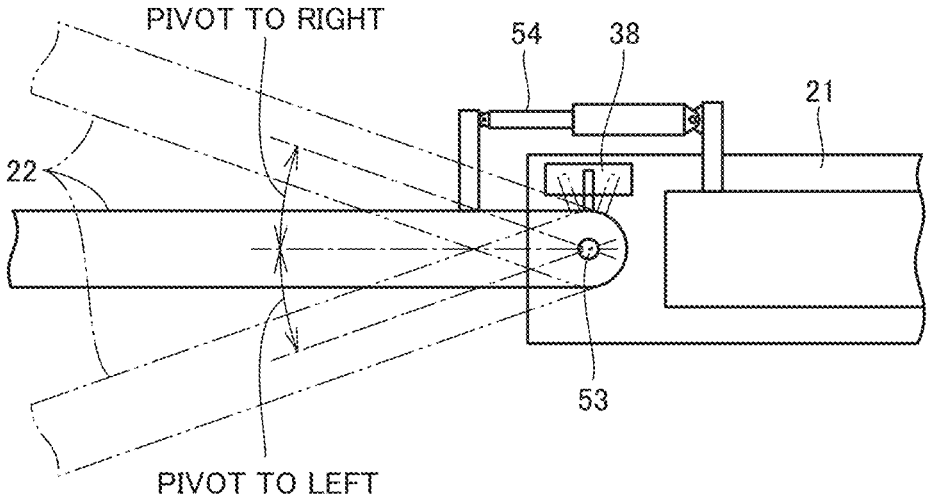
FIG. 4 is a diagram illustrating overview of a construction of a pivot mechanism.

FIG. 4 is a diagram illustrating overview of a construction of the pivot mechanism.

As shown in FIG. 4, front frame 22 and rear frame 21 are coupled to each other by a coupling shaft 53. Coupling shaft 53 extends in the upward/downward direction (a direction perpendicular to the sheet plane in FIG. 4). Coupling shaft 53 is arranged at a position substantially below cab 3 (not shown in FIG. 4).

Coupling shaft 53 couples front frame 22 to rear frame 21 as being pivotable with respect to rear frame 21. Front frame 22 is revolvable in two directions with respect to rear frame 21 with coupling shaft 53 being defined as the center. An angle formed by front frame 22 with respect to rear frame 21 is adjustable.

Front frame 22 pivots with respect to rear frame 21 as a result of extending and retracting of an articulation cylinder 54 coupled between front frame 22 and rear frame 21 based on an operation from cab 3. An angle sensor 38 is attached to rear frame 21, and the angle sensor detects an angle of articulation representing an angle of pivot of front frame 22 with respect to rear frame 21.

By pivoting (articulating) front frame 22 with respect to rear frame 21, a slewing radius in revolution of motor grader 100 can be made smaller and a ditch digging work or a grading work by offset running can be done. Offset running refers to linear travel of motor grader 100 by setting a direction of pivot of front frame 22 with respect to rear frame 21 and a direction of revolution of front wheel 11 with respect to front frame 22 to directions opposite to each other.

As the operator operates articulation control lever 321, an articulation operation is performed. When the operator tilts articulation control lever 321 from a neutral position forward or rearward, the articulation operation starts. As the operator moves articulation control lever 321 back to the neutral position, the articulation operation stops and motor grader 100 maintains an articulation angle at the time when articulation control lever 321 is moved back to the neutral position. When the operator removes his/her hand from articulation control lever 321, articulation control lever 321 automatically returns to the neutral position.

Thus, while the operator is operating articulation control lever 321, the articulation angle varies within a predetermined range of angles. When the operator stops operating articulation control lever 321, motor grader 100 maintains the articulation angle at a time point of stop of the operation.

Articulation cylinder 54 represents an exemplary actuator that pivots front frame 22 with respect to rear frame 21.

Figure 5:
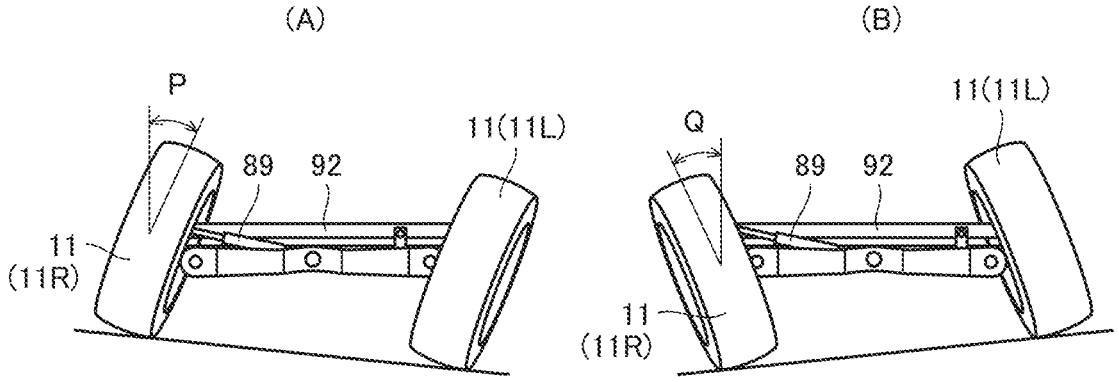
FIG. 5 is a conceptual diagram illustrating a leaning operation of the motor grader.

FIG. 5 is a conceptual diagram illustrating a leaning operation of motor grader 100.

FIG. 5 (A) shows a state of front wheel 11 in a left leaning operation. An example in which front wheel 11 is inclined to the left by an angle P with extending and retracting of leaning cylinder 92 is shown. When motor grader 100 performs a leaning operation as shown in FIG. 5 while motor grader 100 is revolving, for example, to left, (A), a slewing radius in revolution to the left can be smaller.

FIG. 5 (B) shows a state of front wheel 11 in a right leaning operation. An example in which front wheel 11 is inclined to the right by an angle Q with extending and retracting of leaning cylinder 92 is shown. When motor grader 100 performs a leaning operation as shown in FIG. 5 (B) while motor grader 100 is revolving, for example, to the right, a slewing radius in revolution to the right can be smaller.

Motor grader 100 can maintain straight travel performance by performing the leaning operation during works.

<E. System Configuration>

Figure 6:
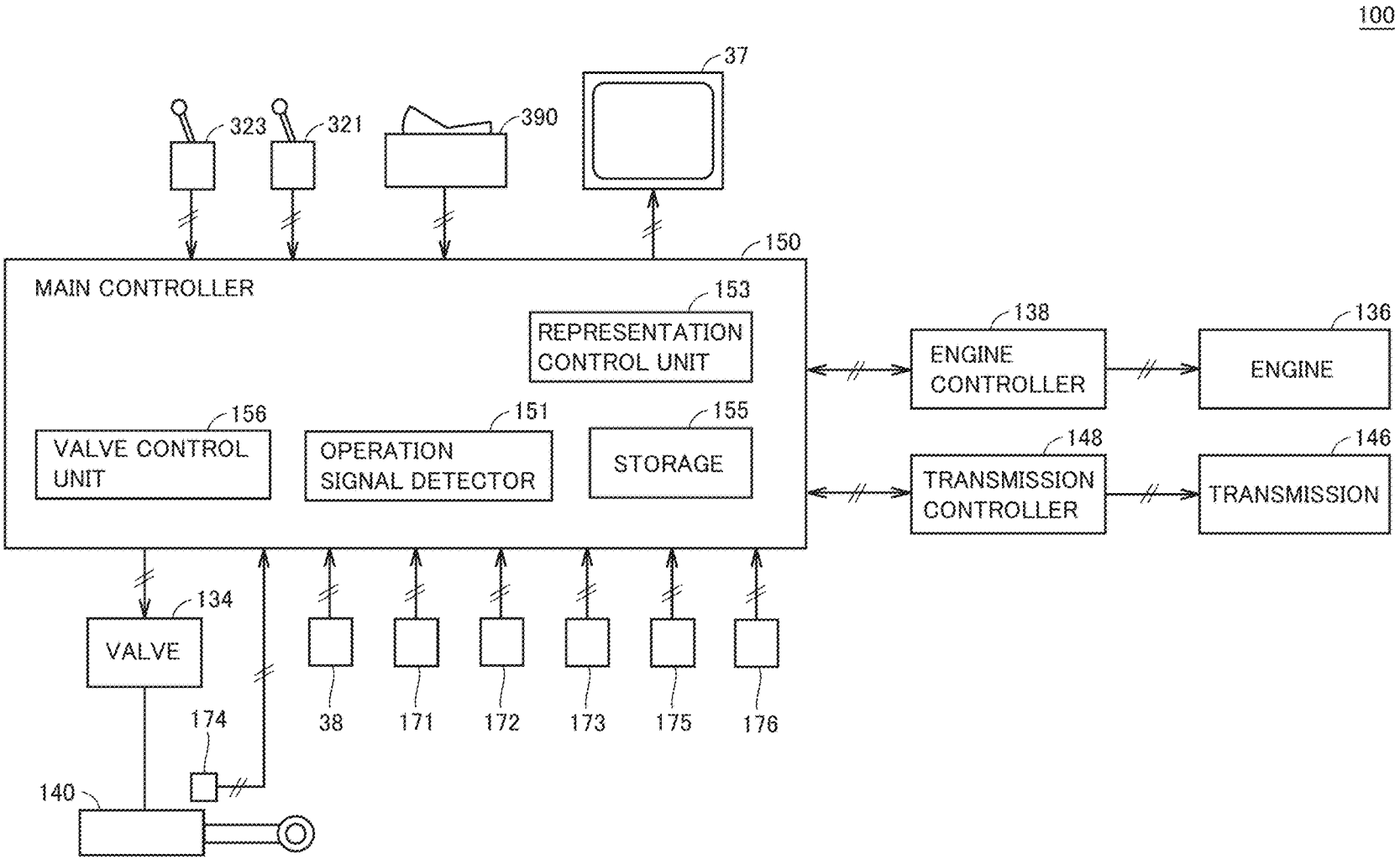
FIG. 6 is a functional block diagram illustrating a configuration of a control system of the motor grader.

FIG. 6 is a functional block diagram illustrating a configuration of a control system of motor grader 100.

FIG. 6 shows relation between a main controller 150 and other peripheral devices. Work implement control lever 323, articulation control lever 321, display apparatus 37, a switch 390, an engine 136, an engine controller 138, a transmission 146, a transmission controller 148, a valve 134, a global navigation satellite system (GNSS) 176, angle sensor 38, sensors 171, 172, 173, 174, and 175, and a hydraulic actuator 140 are shown as the peripheral devices. Exemplary hydraulic actuators 140 include lift cylinders 44 and 45, draw bar shift cylinder 46, blade shift cylinder 47, tilt cylinder 48, slewing motor 49, articulation cylinder 54, steering cylinder 80, and leaning cylinder 92.

Main controller 150 is a controller that controls the entire motor grader 100. Main controller 150 is implemented by a central processing unit (CPU) that executes a program, a non-volatile memory where a program is stored, and the like.

Main controller 150 controls engine controller 138, transmission controller 148, display apparatus 37, valve 134, and the like. Though main controller 150, engine controller 138, and transmission controller 148 are described as being features separate from one another in the present example, they can also be implemented by one common controller. Main controller 150 does not have to control engine controller 138 and transmission controller 148.

Work implement control lever 323, articulation control lever 321, switch 390, display apparatus 37, valve 134, GNSS 176, angle sensor 38, and sensors 171, 172, 173, 174, and 175 are connected to main controller 150.

Work implement control lever 323 provides a lever operation signal (electrical signal) in accordance with a direction of operation and/or an amount of operation to main controller 150. Articulation control lever 321 provides a lever operation signal (electrical signal) in accordance with the direction of operation and/or the amount of operation to main controller 150.

Switch 390 is one of operator operation apparatuses. Switch 390 provides an operation command signal that activates and/or deactivates a specific function to main controller 150.

GNSS 176 detects a position of motor grader 100. GNSS represents a global navigation satellite system. A global positioning system (GPS) represents one example of the global navigation satellite system. GNSS 176 transmits position information of motor grader 100 to main controller 150.

Sensor 171 detects an angle of rotation (blade propulsive angle) of swing circle 41. Sensor 171 transmits information on the angle of rotation of swing circle 41 to main controller 150.

Sensor 172 detects an inclination of blade 42. Sensor 172 is implemented, for example, by an inertial measurement unit (IMU). Sensor 172 transmits inclination information of blade 42 to main controller 150.

Sensor 173 detects an inclination of vehicular body 2. Sensor 173 is implemented, for example, by an inertial measurement unit (IMU). Sensor 173 transmits inclination information of vehicular body 2 to main controller 150.

Sensor 174 detects a position of hydraulic actuator 140. Specifically, sensor 174 detects a stroke length of hydraulic actuator 140. Sensor 174 transmits position information of hydraulic actuator 140 to main controller 150.

Sensor 175 senses an obstacle (including a human) around motor grader 100. Sensor 175 can sense an obstacle in the rear of cab 3. Sensor 175 is used for surveillance of surroundings. Sensor 175 transmits information on the obstacle to main controller 150. The number of sensors 175 is not limited to one. Motor grader 100 may incorporate a similar sensor for detection not only in the rear of cab 3 but also in multiple directions such as left and right of cab 3.

Main controller 150 includes an operation signal detector 151, a representation control unit 153, a storage 155, and a valve control unit 156.

Operation signal detector 151 detects an operation signal from articulation control lever 321. Operation signal detector 151 receives an operation command signal from switch 390. Operation signal detector 151 provides the received operation signal to representation control unit 153.

Representation control unit 153 controls output from display apparatus 37. Representation control unit 153 controls representation on a screen on display apparatus 37. Representation control unit 153 causes display apparatus 37 to show various types of support information (work support information and drive support information). Representation control unit 153 causes display apparatus 37 to show various screens (see FIG. 9) which will be described later.

Various programs to be executed by the CPU are stored in storage 155. For example, information on an engine output torque curve is stored in storage 155.

Valve control unit 156 receives operation signals from work implement control lever 323 and articulation control lever 321. Valve control unit 156 controls drive of hydraulic actuator 140 by controlling valve 134 in accordance with magnitude of a current value which is an operation command to be provided. Valve control unit 156 may correct the current value which is the operation command to valve 134 based on information from sensor 174. Valve 134 is an electromagnetic proportional valve. Valve 134 controls an amount of hydraulic oil to be supplied from a hydraulic pump (not shown) to hydraulic actuator 140 in accordance with the operation signal.

<D. Specific Function>

Figure 9:
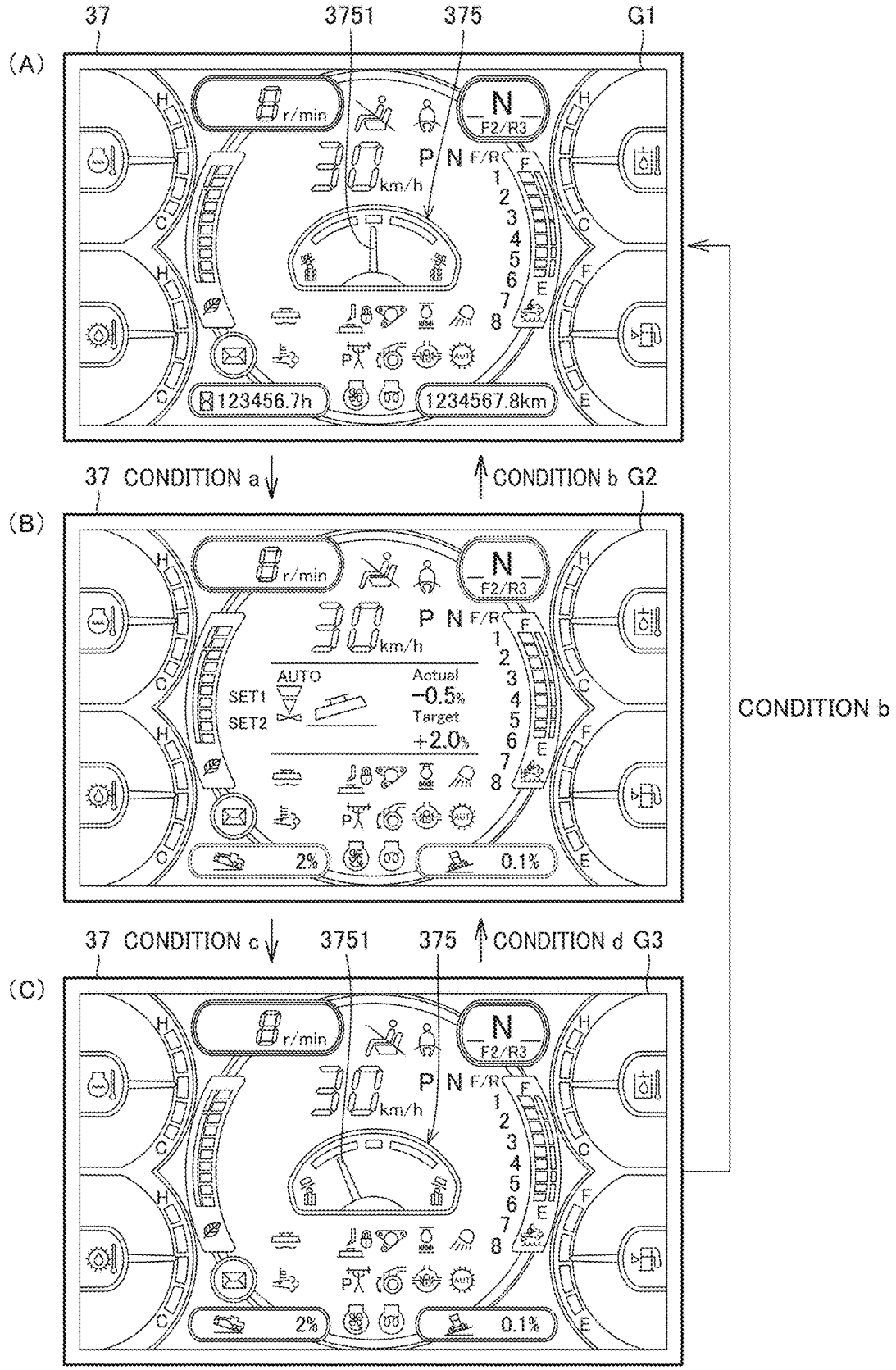
FIG. 9 is a schematic diagram of the screen shown on the display apparatus.

Motor grader 100 shows on display apparatus 37, a state of articulation (a state of pivot of front frame 22) in a default mode (a normal state). While a specific function is active in motor grader 100, motor grader 100 does not show the state of articulation on display apparatus 37. Details of the state of articulation will be described later (FIG. 9). Examples of the specific function will be described below.

The specific function includes a function to carry out automatic control and a function to sense an obstacle around motor grader 100 with sensor 175. Examples of the function to carry out automatic control include automatic control of the work implement and automatic control of travel.

Examples of automatic control of the work implement include cross gradient control and machine control. Machine control refers to control of a blade (dozing blade) based on a difference from information-oriented construction data by obtaining a position of the blade in real time with the use of information from a total station (TS), GNSS 176, and sensor 174. Cross gradient control will be described later.

Examples of automatic control of travel include automatic steering control, an automatic brake operation, automatic cruising control, and automatic control of leaning. Automatic steering control means control of a steering apparatus (system) for changing the direction of travel of motor grader 100.

Overview of cross gradient control will be described below by way of example of automatic control of the work implement.

Figure 7:
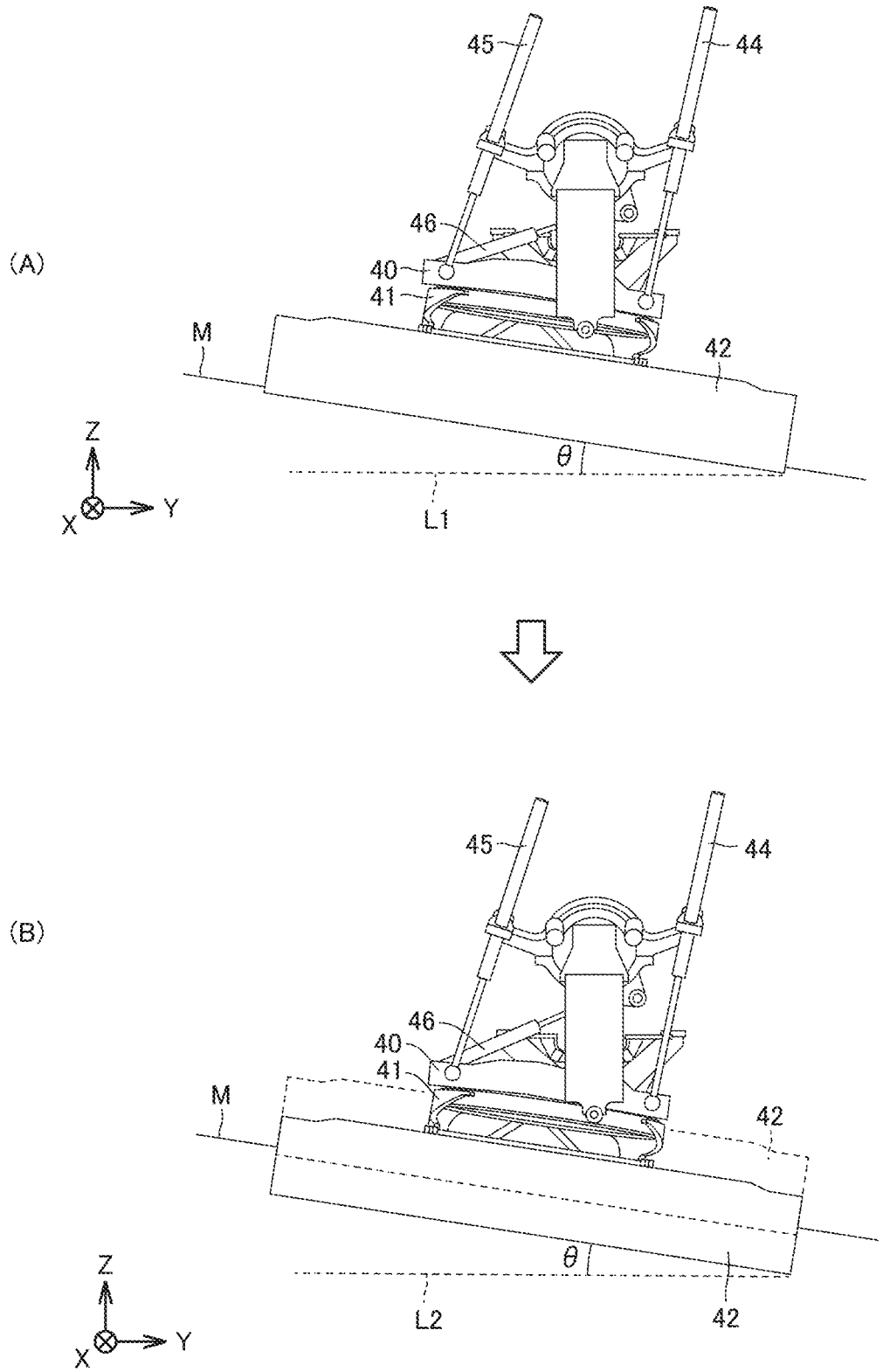
FIG. 7 is a diagram for illustrating overview of cross gradient control.

FIG. 7 is a diagram for illustrating overview of cross gradient control. Cross gradient control refers to a technique for automatic control of blade 42 such that a cross gradient of the ground to be graded conforms to a target cross gradient set by the operator. In cross gradient control, an inclination of blade 42 is automatically controlled. Cross gradient control is carried out based on an instruction from main controller 150. Main controller 150 receives angle information of blade 42, inclination information of blade 42, and inclination information of vehicular body 2 from sensors 171 to 173 and controls blade 42 such that the inclination thereof conforms to the target cross gradient set by the operator. The target cross gradient set by the operator is temporarily stored in storage 155.

In FIG. 7 (A), a graded surface M is graded by blade 42 to conform to a target cross gradient θ (a gradient with respect to a horizontal plane L1) set by the operator.

In FIG. 7 (A), when the operator starts an operation to change the stroke length of one lift cylinder (which is also referred to as a "lift cylinder on a manual control side" below) designated in advance by the operator of lift cylinders 44 and 45, motor grader 100 automatically changes the stroke length of the other lift cylinder (which is also referred to as a "lift cylinder on an automatic control side" below) to maintain target cross gradient θ.

Specifically, when the operator sets lift cylinder 44 as the lift cylinder on the manual control side and when the operator starts an operation to set the stroke length of lift cylinder 44 to be longer (an operation to lower a left end portion of blade 42) as shown in FIG. 7 (B), motor grader 100 automatically sets the stroke length of lift cylinder 45 to be longer to maintain target cross gradient θ.

Cross gradient control is effective even when the operator changes the blade propulsive angle. Even when the blade propulsive angle is changed, motor grader 100 maintains target cross gradient θ set in advance.

<F. Transition of State of Representation on Screen>

Screen transition in display apparatus 37 will be described below. Initially, overview of screen transition will be described. Thereafter, details of screen transition will be described based on a state transition diagram. A specific example of screen transition will further be described.

(f1. Overview of Screen Transition)

Main controller 150 causes display apparatus 37 to show a state of articulation. While the specific function described above is active in motor grader 100, main controller 150 does not allow display apparatus 37 to show the state of articulation. When main controller 150 receives a command to cause articulation cylinder 54 to operate while the state of articulation is not shown on display apparatus 37 owing to the specific function being active, main controller 150 causes display apparatus 37 to show the state of articulation.

When the specific function is active at the time of stop of the operation of articulation cylinder 54, main controller 150 does not allow display apparatus 37 to show the state of articulation. When articulation control lever 321 accepts an operation, it transmits a command to cause articulation cylinder 54 to operate to main controller 150.

(f2. Details of Screen Transition)

Figure 8:
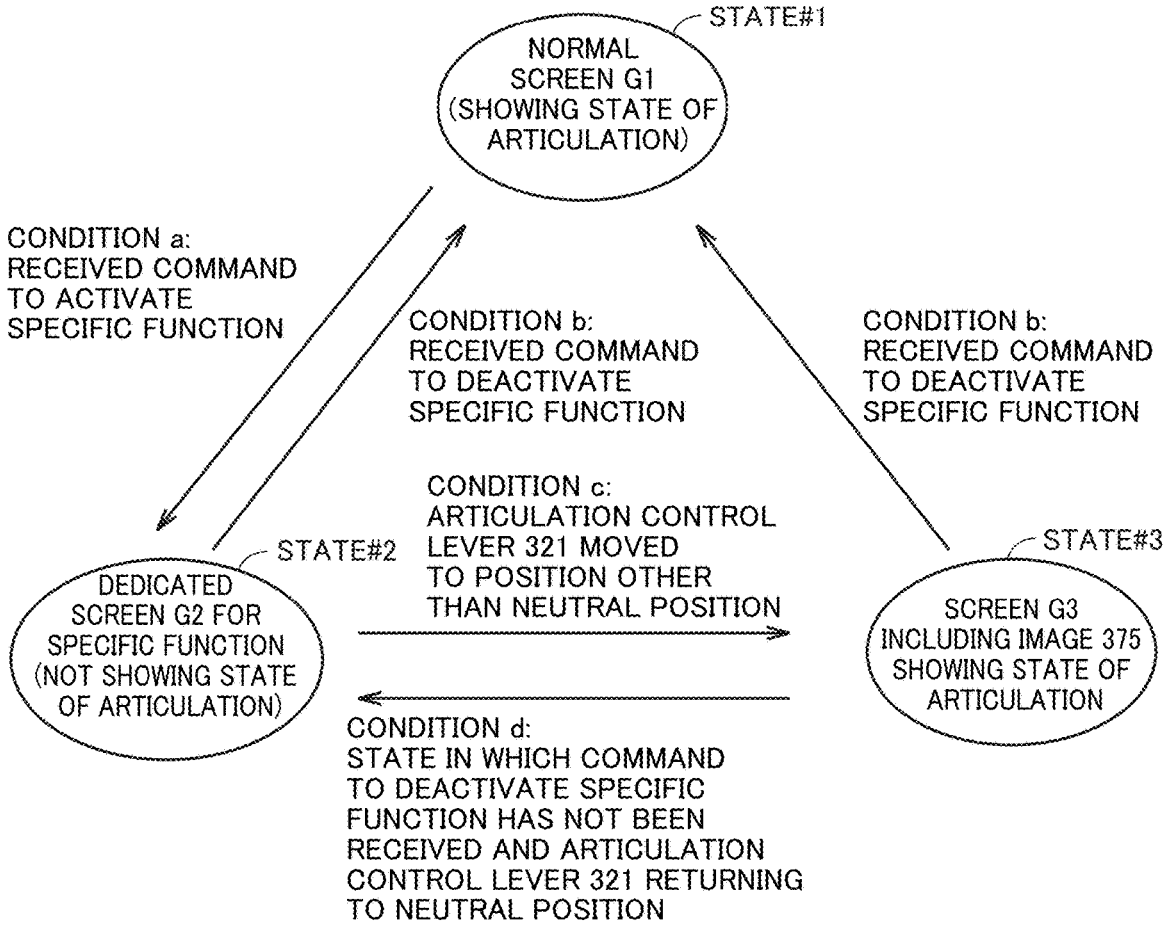
FIG. 8 is a diagram for illustrating transition of a state of a screen shown on a display apparatus.

FIG. 8 is a diagram for illustrating transition of a state of the screen shown on display apparatus 37.

As shown in FIG. 8, representation control unit 153 of main controller 150 initially causes display apparatus 37 to show a normal screen G1 (a state #1). Normal screen G1 includes representation of the state of articulation.

(1) Transition Between State #1 and State #2

Main controller 150 determines whether or not a predetermined condition a has been satisfied in a state (a state #1) in which normal screen G1 is shown on display apparatus 37. Reception of a command to activate the specific function by main controller 150 is defined as condition a.

When condition a has been satisfied in state #1, representation control unit 153 causes display apparatus 37 to show a dedicated screen G2 for the specific function (a state #2). Thus, representation control unit 153 makes transition of a screen state from state #1 to state #2. Dedicated screen G2 does not include representation of the state of articulation.

Main controller 150 determines whether or not a predetermined condition b has been satisfied in a state (a state #2) in which dedicated screen G2 is shown on display apparatus 37. Reception of a command to deactivate the specific function by main controller 150 is defined as condition b.

When condition b has been satisfied in state #2, representation control unit 153 causes display apparatus 37 to show normal screen G1 (state #1). Representation control unit 153 thus makes transition of the screen state from state #2 to state #1.

(2) Transition Between State #2 and State #3

Main controller 150 determines whether or not a predetermined condition c has been satisfied in the state (state #2) in which dedicated screen G2 is shown on display apparatus 37. Movement of articulation control lever 321 to a position other than the neutral position is defined as condition c. Specifically, reception of an operation signal from articulation control lever 321 by main controller 150 is defined as condition c. Reception of a command to cause articulation cylinder 54 to operate by main controller 150 is defined as condition c.

When condition c has been satisfied in state #2, representation control unit 153 causes display apparatus 37 to show a screen G3 including an image 375 (see FIG. 9) showing the state of articulation (a state #3). Representation control unit 153 thus makes transition of the screen state from state #2 to state #3.

Main controller 150 determines whether or not a predetermined condition d has been satisfied in a state (state #3) in which screen G3 is shown on display apparatus 37. Return of articulation control lever 321 to the neutral position while main controller 150 does not receive the command to deactivate the specific function is defined as condition d. Specifically, that the specific function is active and main controller 150 has determined to stop the operation of articulation cylinder 54 is defined as condition d.

When condition d has been satisfied in state #3, representation control unit 153 causes display apparatus 37 to show dedicated screen G2 (state #2). Representation control unit 153 thus makes transition of the screen state from state #3 to state #2.

(3) Transition from State #3 to State #1

Main controller 150 determines whether or not condition b described above has been satisfied in the state (state #3) in which screen G3 is shown on display apparatus 37. When condition b has been satisfied in state #3, representation control unit 153 causes display apparatus 37 to show normal screen G1 (state #1). Representation control unit 153 thus makes transition of the screen state from state #3 to state #1.

(f3. Specific Example of Screen Transition)

An exemplary screen shown on display apparatus 37 will specifically be described below with reference to an example in which cross gradient control is designated as the specific function.

FIG. 9 is a schematic diagram of the screen shown on display apparatus 37.

As shown in FIG. 9, a screen shown on display apparatus 37 makes transition based on conditions a to d described above. FIG. 9 (A) corresponds to state #1 in FIG. 8. FIG. 9 (B) corresponds to state #2 in FIG. 8. FIG. 9 (C) corresponds to state #3 in FIG. 8.

As shown in FIG. 9 (A), normal screen G1 includes image 375 showing at least the state of articulation. Image 375 shows an articulation angle. Image 375 includes a pointer 3751.

When front frame 22 has pivoted (articulated) to the right with respect to rear frame 21, pointer 3751 tilts to the right in accordance with the articulation angle. When front frame 22 has pivoted to the left with respect to rear frame 21, pointer 3751 tilts to the left in accordance with the articulation angle. The operator can determine the current state of articulation (articulation angle) depending on a position indicated by pointer 3751.

When condition a described above is satisfied in FIG. 9 (A), dedicated screen G2 for cross gradient control is shown on display apparatus 37 as shown in FIG. 9 (B).

Dedicated screen G2 shows in a screen central portion, an image in connection with cross gradient control instead of image 375 showing the state of articulation. Specifically, representation control unit 153 has images shown in the screen central portion, the images being an image showing an actually measured cross gradient (%), an image showing a target cross gradient (%), and an image showing a state of the target cross gradient (an image showing the blade and the horizontal plane).

Since image 375 showing the state of articulation is thus not shown on dedicated screen G2, the operator is unable to check the state of articulation on display apparatus 37.

When condition b described above is satisfied in FIG. 9 (B), normal screen G1 instead of dedicated screen G2 is shown on display apparatus 37 as shown in FIG. 9 (A).

When condition c described above is satisfied in FIG. 9 (B), screen G3 including image 375 showing the state of articulation instead of dedicated screen G2 is shown on display apparatus 37 as shown in FIG. 9 (C).

When condition d described above is satisfied in FIG. 9 (C), dedicated screen G2 instead of screen G3 is shown on display apparatus 37 as shown in FIG. 9 (B). When condition b described above is satisfied in FIG. 9 (C), normal screen G1 instead of screen G3 is shown on display apparatus 37 as shown in FIG. 9 (A).

Attention is paid to transition from FIG. 9 (B) to FIG. 9 (C) as below. As shown in FIG. 9 (B), in spite of absence of representation of the state of articulation on display apparatus 37 by activation of cross gradient control by motor grader 100, when the operator moves articulation control lever 321 from the neutral position for starting articulation, the state of articulation is shown on display apparatus 37 as shown in FIG. 9 (C).

As set forth above, as the operator performs an operation to change the state of articulation while cross gradient control is active, the state of articulation (a changed state) is shown on display apparatus 37. Thus, according to motor grader 100, the state of articulation can be shown on the display apparatus at timing suitable for the operator.

Attention is paid to transition from FIG. 9 (C) to FIG. 9 (B) as below. When articulation control lever 321 returns to the neutral position while the state of articulation is shown on display apparatus 37 as shown in FIG. 9 (C), the state of articulation is no longer shown as shown in FIG. 9 (B), and instead, an image in connection with cross gradient control is shown in the center of the screen.

Thus, when the articulation operation stops, an image in connection with cross gradient control is shown, on condition that cross gradient control is active.

Therefore, after articulation cylinder 54 stops, the operator can visually recognize various types of information on cross gradient control on display apparatus 37.

<G. Modification>

The operation apparatus for causing articulation cylinder 54 to operate is not limited to articulation control lever 321. For example, the operation apparatus for causing articulation cylinder 54 to operate may be a momentary switch.

Figure 10:
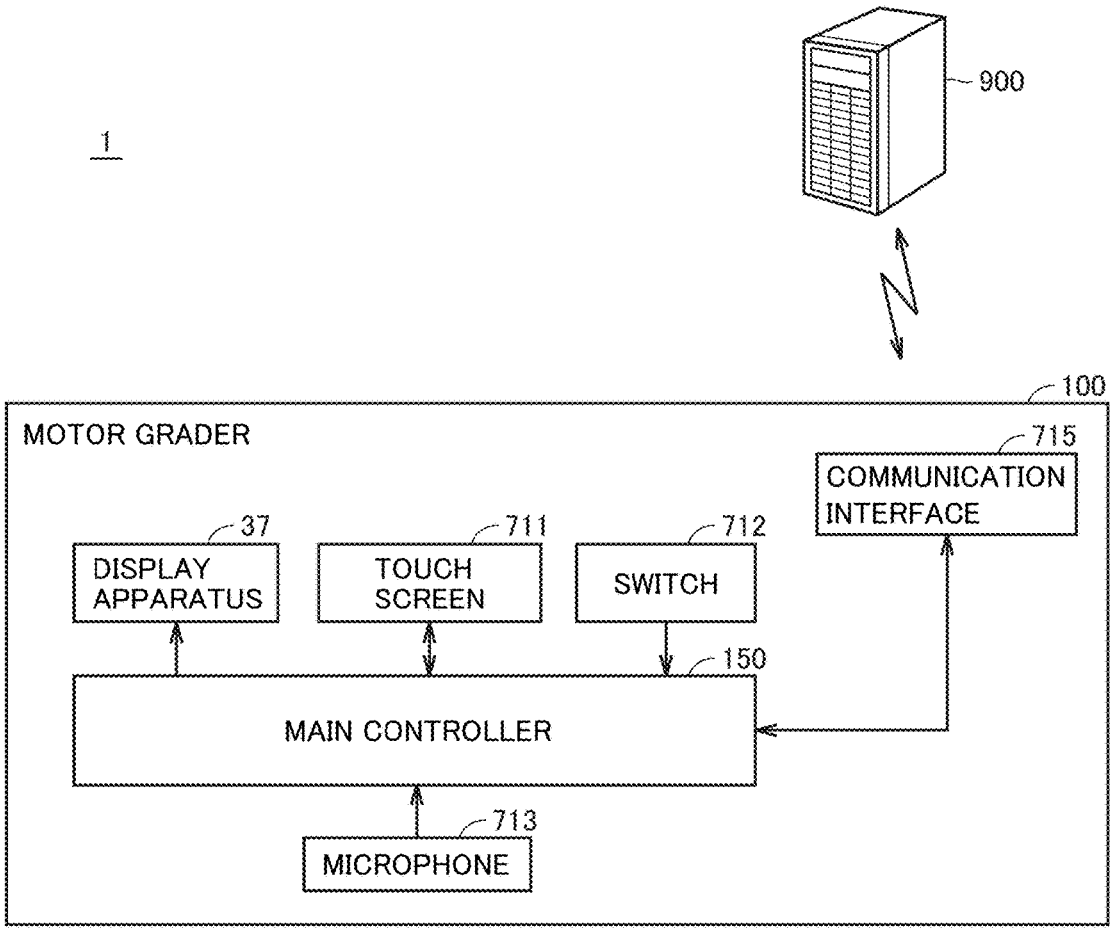
FIG. 10 is a diagram for illustrating another apparatus configuration for causing an articulation cylinder to operate.

FIG. 10 is a diagram for illustrating another apparatus configuration for causing articulation cylinder 54 to operate.

As shown in FIG. 10, a system 1 includes motor grader 100 and a server 900. Motor grader 100 can communicate with server 900. Motor grader 100 includes at least main controller 150, display apparatus 37, a touch screen 711, a switch 712, a microphone 713, and a communication interface 715.

Main controller 150 communicates with server 900 through communication interface 715. The touch screen includes a display and a touch panel.

Motor grader 100 may be configured such that, in response to an operation onto any one of touch screen 711 and switch 712, a command to cause articulation cylinder 54 to operate is transmitted from such an apparatuses to main controller 150.

Alternatively, motor grader 100 may be configured such that, based on an audio input through microphone 713, a command to cause articulation cylinder 54 to operate is transmitted from such an apparatus to main controller 150.

Alternatively, motor grader 100 may be configured such that main controller 150 receives a command to cause articulation cylinder 54 to operate from server 900 through communication interface 715.

It should be understood that the embodiment disclosed herein is illustrative and non-restrictive in every respect. The scope of the present invention is defined by the terms of the claims rather than the description above and is intended to include any modifications within the scope and meaning equivalent to the terms of the claims.

REFERENCE SIGNS LIST

1 system; 2 vehicular body; 3 cab; 4 work implement; 6 engine compartment; 9 inertial measurement apparatus; 11 front wheel; 11L left front wheel; 11R right front wheel; 12 rear wheel; 21 rear frame; 22 front frame; 25 exterior cover; 31 operator's seat; 32R, 32L console; 34 steering wheel; 37 display apparatus; 38 angle sensor; 40 draw bar; 41 swing circle; 42 blade; 44, 45 lift cylinder; 46 draw bar shift cylinder; 47 blade shift cylinder; 48 tilt cylinder; 49 slewing motor; 51 counterweight; 53 coupling shaft; 54 articulation cylinder; 92 leaning cylinder; 100 motor grader; 140 hydraulic actuator; 150 main controller; 151 operation signal detector; 153 representation control unit; 155 storage; 156 valve control unit; 171, 172, 173, 174, 175 sensor; 176 GNSS; 321 articulation control lever; 322 leaning control lever; 375 image; 390 switch; 900 server; 3751 pointer; G1 normal screen; G2 dedicated screen; G3 screen; L1, L2 horizontal plane; M graded surface

The invention claimed is:

1. A motor grader comprising:

a front frame;

a rear frame;

an actuator that pivots the front frame with respect to the rear frame;

an operator operation apparatus that accepts an operation to cause the actuator to operate;

a display apparatus; and a controller, the controller causing the display apparatus to show a first image showing a state of pivot in a predetermined display area of the display apparatus when the operator operation apparatus accepts the operation and switching an image to be shown in the predetermined display area from the first image to a second image different from the first image when acceptance of the operation ends.

2. The motor grader according to claim 1, wherein the second image is an image showing a state of automatic control carried out in the motor grader.

3. The motor grader according to claim 2, further comprising a work implement, wherein the automatic control carried out in the motor grader is control that causes the work implement to automatically operate.

4. The motor grader according to claim 3, wherein the control that causes the work implement to automatically operate is cross gradient control.

5. The motor grader according to claim 1, wherein the operator operation apparatus is any one of a control lever, a control switch, and a touch screen.

6. A motor grader comprising:

a front frame;

a rear frame;

an actuator that pivots the front frame with respect to the rear frame;

a display apparatus; and a controller that causes the display apparatus to show an image showing a state of pivot, wherein the controller does not allow the display apparatus to show the image showing the state of pivot while a specific function is active in the motor grader, and causes the display apparatus to show the image showing the state of pivot when the controller receives a command to cause the actuator to operate while the image showing the state of pivot is not shown on the display apparatus owing to the specific function being active.

7. The motor grader according to claim 6, wherein the controller does not allow the display apparatus to show the image showing the state of pivot while the specific function is active at time of stop of an operation of the actuator.

8. The motor grader according to claim 6, further comprising an operation apparatus that transmits the command to the controller when the operation apparatus accepts an operation.

9. The motor grader according to claim 8, wherein the operation apparatus is any one of a control lever, a control switch, and a touch screen.

10. The motor grader according to claim 6, further comprising a microphone that accepts the command as an audio input and transmits the command to the controller.

11. The motor grader according to claim 6, wherein the controller receives the command from a server apparatus communicatively connected to the motor grader.

12. The motor grader according to claim 6, wherein the specific function is a function to carry out automatic control in the motor grader.

13. The motor grader according to claim 12, further comprising a work implement, wherein the automatic control is automatic control that causes the work implement to automatically operate.

14. The motor grader according to claim 13, wherein the automatic control that causes the work implement to automatically operate is cross gradient control.

15. The motor grader according to claim 13, wherein the automatic control that causes the work implement to automatically operate is a machine control system.

16. The motor grader according to claim 12, wherein the automatic control is control that causes the motor grader to automatically travel.

17. The motor grader according to claim 16, further comprising steering, wherein the control that causes the motor grader to automatically travel is control of the steering.

18. The motor grader according to claim 16, wherein the control that causes the motor grader to automatically travel is control of an accelerator operation and a brake operation.

19. The motor grader according to claim 16, further comprising a mechanism that performs a leaning operation, wherein the control that causes the motor grader to automatically travel is control of the leaning operation.

20. The motor grader according to claim 6, further comprising a sensor that senses surroundings of the motor grader, wherein the specific function is a function to sense the surrounding with the sensor.

21. A method of controlling representation in a motor grader including a controller, the method comprising:

causing a display apparatus to show an image showing a state of articulation of the motor grader;

accepting, by an operator operation apparatus, an operation to cause an actuator for carrying out the articulation to operate; and causing, by the controller, the display apparatus to show a first image showing the state of articulation in a predetermined display area of the display apparatus when the operator operation apparatus accepts the operation and switching, by the controller, an image to be shown in the predetermined display area from the first image to a second image different from the first image when acceptance of the operation ends.

22. A method of controlling representation in a motor grader including a controller, the method comprising:

causing a display apparatus to show an image showing a state of articulation of the motor grader;

deactivating causing the display apparatus to show the image showing the state of articulation while a specific function is active in the motor grader;

receiving a command to cause an actuator for carrying out the articulation to operate while the image showing the state of articulation is not shown on the display apparatus owing to the specific function being active; and causing the display apparatus to show the image showing the state of articulation based on reception of the command.

* * * * *